US005850657A

United States Patent [19]

List et al.

[11] Patent Number: 5,850,657

[45] Date of Patent: Dec. 22, 1998

[54] WOODWORKING TOOL FOR PREPARING A WOOD SURFACE FOR FINISHING

[75] Inventors: Richard S. List, Northborough; Andre J. Lazure, Southbridge; Mark S. Corriveau, Sturbridge; Steven J. Corron, Shrewsbury, all of Mass.

[73] Assignee: Hyde Tools, Southbridge, Mass.

[21] Appl. No.: 779,408

[22] Filed: Jan. 7, 1997

[51] Int. Cl.[6] ..... A47L 13/08

[52] U.S. Cl. ..... 15/105; 15/236.01; 15/236.05

[58] Field of Search ..... 15/105, 235.4, 15/236.01, 236.05; 30/169, 172

[56] References Cited

U.S. PATENT DOCUMENTS

| | | | |
|---|---|---|---|
| 180,187 | 7/1876 | Bartlett . | |
| 912,028 | 2/1909 | Prout . | |
| 1,055,851 | 3/1913 | Allman | 15/105 |
| 1,261,844 | 4/1918 | Orr . | |
| 1,434,744 | 11/1922 | Hibbler | 15/236.05 |
| 1,779,293 | 10/1930 | Rodgers . | |
| 2,496,280 | 2/1950 | Endicott . | |
| 2,593,304 | 4/1952 | Howard . | |
| 2,674,794 | 4/1954 | Baker . | |
| 2,828,502 | 4/1958 | Tupper | 15/236.05 |
| 3,091,852 | 6/1963 | De Larber . | |
| 3,155,997 | 11/1964 | Gallagher . | |
| 4,524,514 | 6/1985 | Mallalieu et al. | 30/169 |
| 5,009,009 | 4/1991 | Stinson | 15/236.01 |
| 5,020,181 | 6/1991 | Leonard . | |
| 5,455,981 | 10/1995 | Wiese . | |

*Primary Examiner*—Terrence Till

*Attorney, Agent, or Firm*—Lackenbach Siegel Marzullo Aronson & Greenspan, P.C.

[57] ABSTRACT

A woodworking tool includes an elongate hand grip. A scraper element is provided at one end of the hand grip and a spreader element at the other end of the hand grip. The spreader element is substantially more flexible than the scraper element so that each may alternatingly be used to prepare a wood surface for finishing by reversing the relative positions of the elements within the hand of the user.

23 Claims, 2 Drawing Sheets

WOODWORKING TOOL FOR PREPARING A WOOD SURFACE FOR FINISHING

BACKGROUND OF THE INVENTION

1. Field of the Invention

The present invention generally relates to woodworking tools, and more specifically, to such a tool which includes spreader and scraper elements for alternatingly preparing a wood surface for finishing.

2. Description of the Prior Art

Combination multi-purpose tools of various types are known in the prior art. U.S. Pat. No. 912,028, issued to Prout, discloses a putty knife that is adapted for scraping painted or other surfaces while retaining its customary function of applying putty. In this patent, the scraper is provided on one side of the putty knife blade, so that alternating between the two functional elements involves rotating the tool 180° about its longitudinal axis. However, this patent fails to teach any specific dimensional relationships or discuss the relative stifffness of the scraper as compared to the flexibility of the spreading blade, and in fact, both are limited in their relative flexibility and/or stiffness by their mutual attachment.

In U.S. Pat. No. 2,496,280, issued to Endicott, a plasterer's tool is disclosed in which the blade is described as being useful for scraping old finish coats from plaster and removing plaster from wood laths, as well as for removing wallpaper and the like. The other end of the tool, however, is provided with a cutter useful for plaster and masonry work.

A hand tool for removing hardened putty from window panes and sashes is disclosed in U.S. Pat. No. 3,091,852 issued to Larber. This combination tool is also provided with functional units at both ends. However, the distal end of the handle is provided with a tapered edge that incorporates a "V" notch, similar to those provided in hammers for pulling nails. The other end of the tool incorporates ribs with knife-life edges on its vertical sides and has a beveled tip, for either scraping or plowing old putty out of window joints.

A jointer and raking tool is disclosed in U.S. Pat. No. 3,155,997 issued to Gallagher. This tool is used for raking and smoothing mortar to produce well defined joints in masonry work.

In U.S. Pat. No. 5,455,981 to Wiese, a paint scraper is disclosed that incorporates means for minimizing arm fatigue and cramping when pulling or pushing the blade along the surface to be scraped. This is achieved by an upwardly extending lever arm and "cradle" that engages the forearm of the user.

In some instances, multi-purpose tools are provided with an in-line tool element along the longitudinal axis of the handle at one end, and a substantially transverse element at the other end. See, for example, U.S. Pat. Nos. 2,674,794 to Baker (multi-purpose tool) and 1,779,293 to Rodgers painter's implement). The former is a scraper/hammer/screwdriver/chisel combination while the latter combines only putty knife and hammer. U.S. Pat. No. 180,187 to Bartlett combines putty—knives and screw-drivers. In U.S. Pat. No. 5,020,181 to Leonard, a scraping tool "kit" is disclosed which is designed to readily access and scrape the interior surface of a lawn mower. A chisel and serrated scraper are combined with wire brush and honing stone. This tool would not be suitable for applying putty or finishing a wood surface. In U.S. Pat. No. 2,593,304 to Howard, a hive tool is disclosed which combines a unique scraping head at one end with a chisel and/or prying element at the other, similar in shape to the common prybar, and lacking, of course, the flexibility required of a putty knife, due to the stiffness required by its intended functions. U.S. Pat. No. 1,261,844 to Orr discloses in a combination tool for painters' use. The tool is formed from "spring metal" and may be employed as a putty knife, can opener or door wedge; and even, presumably, as a scraper. Once again, however, the scraping and spreading functions are accomplished by the same element (common to both functions), so that should its selected thickness favor one function (thicker and stiffer for scraping, as opposed to thinner, more flexible, for spreading) then the other function would be impaired.

However, woodworkers, particularly cabinet makers, frequently have the alternating tasks of first scraping a wood surface and then repairing the gouges that inevitably occur with a suitable filler compound. Cracks and crevices, likewise, must be filled and smoothed-over, while excess adhesive that exudes from freshly joined corners, abutments and laminates must be removed. Furthermore, there is a need for quick and easy removal of fast drying fillers and adhesives that have adhered to the tools. the aforementioned prior art tools, including the full range of conventional scrapers and putty knives, have not facilitated the above requirements. Typically, the woodworker must alternately lay down the scraper and pick-up the putty knife; then put down the putty knife and pick-up the scraper—taking care to frequently wipe off the quick-drying filer compounds and adhesives before they harden. There is the need, therefore, for a unique combination scraper and putty knife tool; one that is readily cleaned, to expedite and speed production of cabinets and furniture in general.

SUMMARY OF THE INVENTION

Accordingly, it is an object of the present invention to provide a woodworking tool which does not have the disadvantages or limitations inherent in prior art scrapers, putty knives, combination or multi-purpose tools.

It is another object of the present invention to provide a woodworking tool of the type under discussion which is specifically designed to facilitate multiple operations in the production of furniture, cabinets or laminates.

It is yet an additional object of the invention to provide a woodworker's scraping tool as suggested in the previous objects that is adapted to remove and/or smooth over excess filler materials and adhesives that exude from joints and cracks.

It is a further object of the present invention to provide a woodworking tool as in the previous objects which can effectively perform the functions of a scraper and spreader to speed production, and yet be readily cleaned.

It is still a further object of the present invention to provide a woodworking tool which facilitates the quick and easy removal of fast drying adhesives and fillers from the tool.

It is yet a further object of the present invention to provide a woodworking tool which is easier and more convenient to use than prior art scrapers, putty knives or combination, multi-purpose tools.

It is an additional object of the present invention to provide a woodworking tool which is comfortable and safe to hold and use.

It is still an additional object of the present invention to provide a woodworking tool which is simple in construction and economical to manufacture.

In order to achieve the above objects, as well as others that will become apparent hereinafter; a woodworking tool in accordance with the present invention comprises an elongate handle or hand grip, a scraper element at one end of the hand grip and a spreader element at the other end. The spreader element is substantially more flexible than the scraper element. In this manner, the stiffer scraper element and more flexible spreader element may be alternatingly employed to prepare a wood surface for finishing by reversing the relative positions of said elements within the hand of the user.

The woodworker's tool of the present invention is specifically designed to facilitate multiple operations in the production of furniture, cabinets and laminates; particularly scraping and spreading.

BRIEF DESCRIPTION OF THE DRAWINGS

Other objects and advantages of the present invention will become apparent from the following detailed description of its preferred embodiment when taken in conjunction with the drawings, as follows.

DESCRIPTION OF A PREFERRED EMBODIMENT

Figure 1:
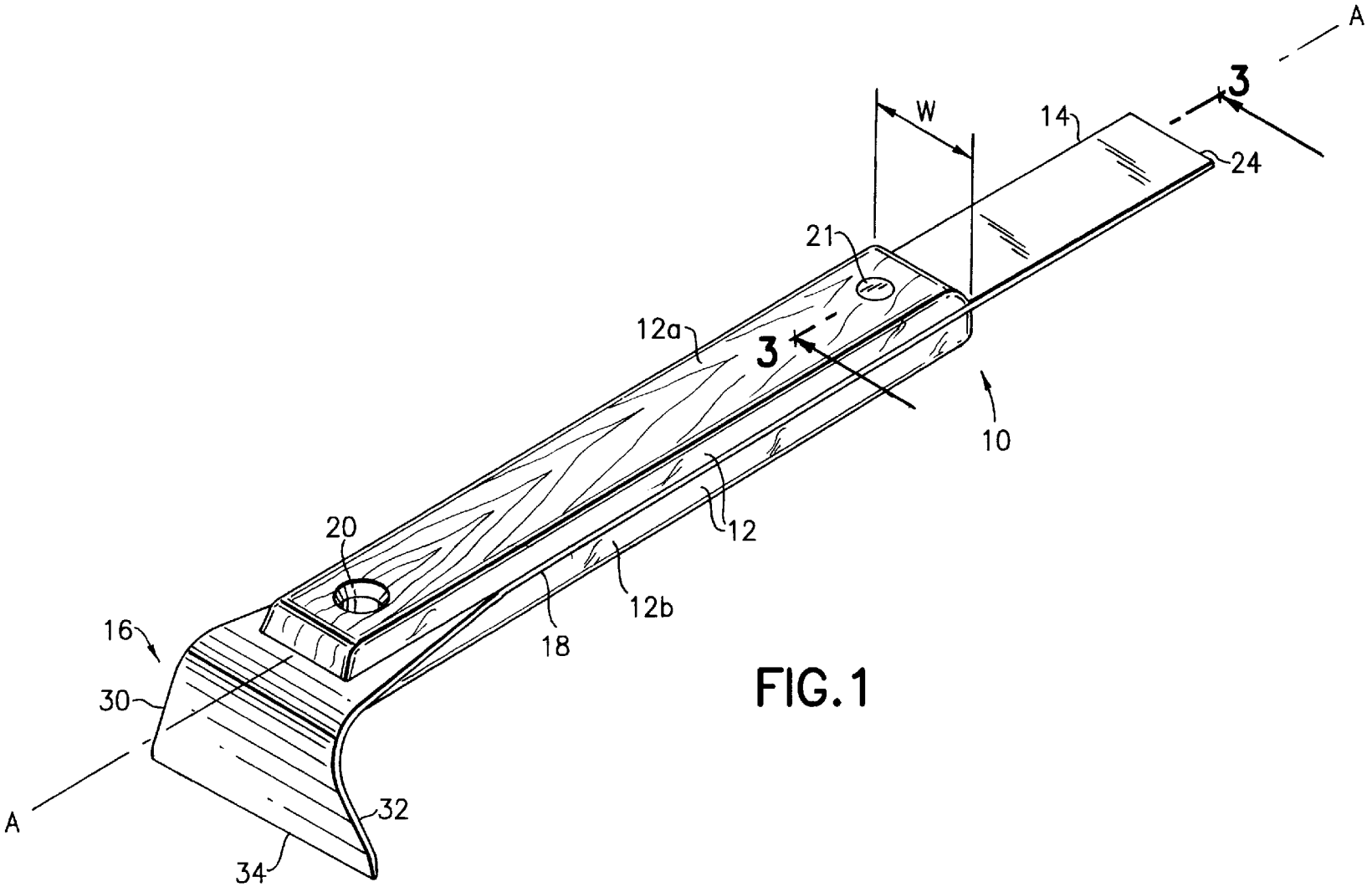
FIG. 1 is a perspective view of a woodworking tool in accordance with the present invention.

Referring now more specifically to the figures, in which identical or similar parts are designated by the same reference numerals throughout, the woodworking tool in accordance with the present invention is generally designated by the reference numeral 10.

The tool 10 is generally longitudinal and defines a tool. axis A. A generally longitudinal handle 12 extends along the axis A and is formed of two similar handle members 12*a*, 12*b*, fastened to each other as will subsequently be described.

Extending or projecting longitudinally along the axis A, at one end of handle 12, is a spreader element 14. At the other longitudinal end of handle 12 there is provided a scraper element 16. While the spreader element 14 and scraper element 16 may be separate components attached to handle 12 by any conventional means, they are, in the presently preferred embodiment, integrally formed from a common "blade" having an intermediate portion 18 that extends the entire longitudinal length of handle 12 and is sandwiched between handle members 12*a*, 12*b*. Any type of conventional fastener may be used to secure the handle members 12*a*, 12*b* to each other and to the intermediate portion of the blade 18. In the embodiment illustrated in FIG. 1, a grommet 20 is employed at one end of the handle while a rivet 21 is used at the other end. Threaded fasteners could also be used, as could adhesives or even weldments.

Figure 2:
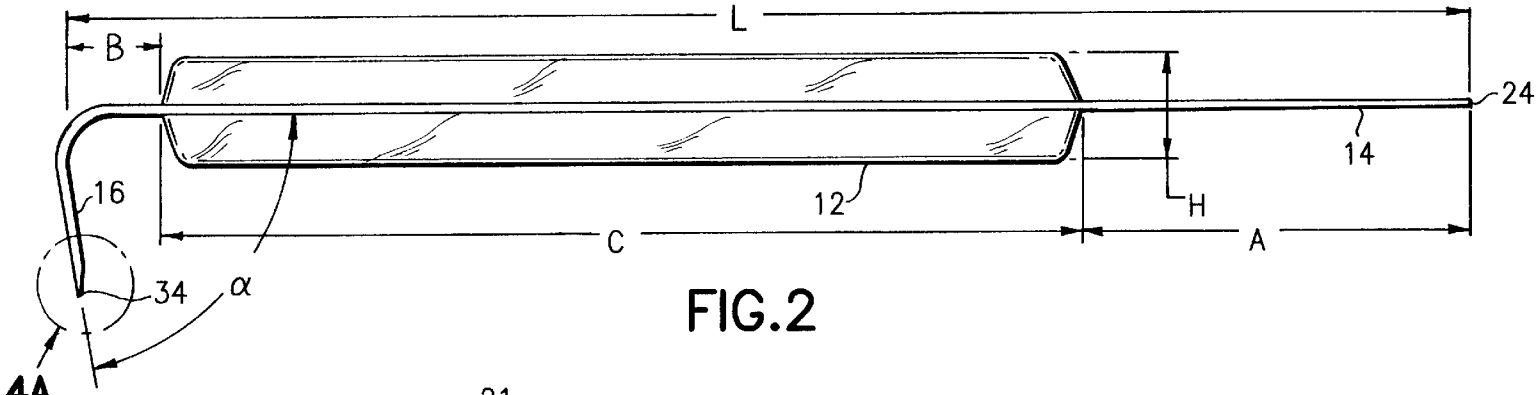
FIG. 2 is a side elevational view of the woodworking tool shown in FIG. 1.
Figure 3:
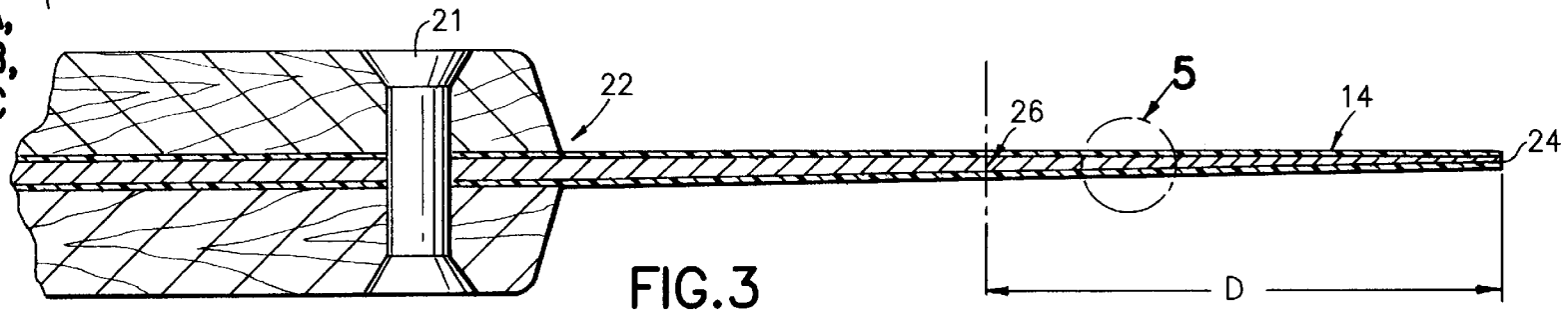
FIG. 3 is an enlarged, fragmented view, in cross-section, of the spreader portion of the tool shown in FIGS. 1 and 2.
Figure 6:
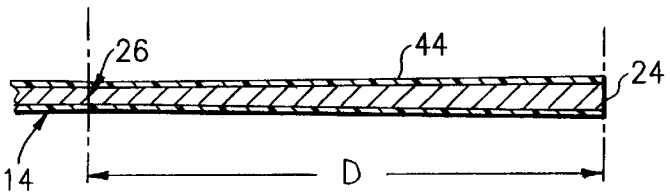
FIG. 6 is a fragmented view in cross-section of the spreader portion of the tool shown in FIG. 3.
Figure 5:
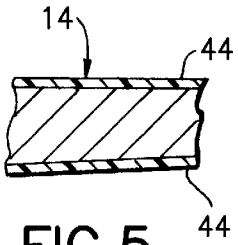
FIG. 5 is an enlarged detail of the spreader element in the encircled region designated by the number 5 in FIG. 3.

A salient feature of the invention is that the spreader element 14 and scraper element 16 are specifically configured to provide optimum functionality for their intended purposes. Thus, the spreader blade 14 is generally rectangular in shape, having an edge 24 with sharp corners. However, as best shown in FIGS. 2 and 3, while the intermediate blade portion 18 is substantially uniform in thickness, the spreader element or blade 14 is tapered, starting at the point 22 where the spreader blade 14 projects from the handle 12. The taper may extend continuously from point 22 toward the tip or remote edge 24 of the blade, as shown in FIGS. 2 and 3, or may have an optional point of inflection at an intermediate location 26, as shown in FIG. 6, along the longitudinal length of the spreader blade 14 between the remote edge 24 and handle 12 in order to provide a cross section of minimum thickness and, therefore, maximum flexibility, spaced inwardly from the remote edge. Clearly, when a continuous taper is provided, the thinnest part of the spreader blade 14 will be at the very tip or edge 24 of that blade. Such a design, characteristically, will not result in an optimum spreader, since the most flexible part of the blade is then, of course, at its very tip and such a blade becomes, therefore, progressively stiffer or less flexible at locations removed from the remote edge. A spreader element or blade, however, incorporating the aforesaid inwardly spaced point of inflection 26 allows considerably more blade contact with the "working surface" than a blade not having this feature, given any particular magnitude of applied force, resulting in a more efficient spreading tool. It should be clear, therefore, that slightly different configurations may be provided at the operative end of the spreader blade 14 to suit a specific application or user. Optimally, at the point of inflection 26 (FIG. 3), the thickness of the spreader blade 14 is 0.015 inches, although this thickness may vary from 0.007–0.030 inches. The thickness of the spreader blade 14 at the tip or remote edge 24 is optimally 0.025 inches, although this thickness may range between 0.010–0.050 inches. Where an optional flex point (i.e., point of inflection 26) is provided, it may be typically spaced from the remote edge a distance D equal to approximately one inch. With these dimensions, the longitudinal length of the spreader blade 14 is optimally 2 inches, although the length of this blade can vary within the range of 1.0–6.0 inches. (increasing the length of the spreader blade 14 beyond this range will cause it to dig into the typical user's forearm when the tool is employed in its scraping mode.)

The operative elements, as previously suggested, are integrally formed from a common "blade", preferably, but not limited to hardened steel having optimal thickness of 0.05 inches, although such blade material can be selected within the range of 0.020–0.125 inches. These are also, of course, the thicknesses of the scraping element 16 and the intermediate blade portion 18, although the very tip or edge 34 of the scraping element 16 may be tapered to provide a sharper, more efficient scraping edge. To further enhance the effectiveness of the scraping element 16, it is preferably provided with outwardly projecting "ears" 30, 32 that substantially increase its width.

Figure 4C:
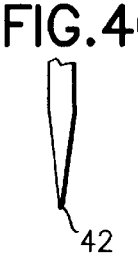
FIGS. 4B and 4C are similar to FIG. 4A but illustrate alternative cross-sections for the scraper edge.
Figure 4B:
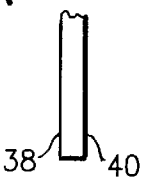
Figure 4A:
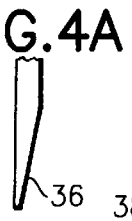
FIG. 4A is an enlarged detail of the region of the scraper element indicated by the circle 4A in FIG. 2.

As previously indicated, the scraping edge 34 may be tapered or bevelled on one surface 36 (FIG. 4A). Alternatively, the edge 34 may be straight-sided or slightly tapered on both surfaces 38, 40 (FIG. 4B) or yet more substantially tapered on both sides to provide a sharp point or edge 42 (FIG. 4C).

Referring to FIG. 2, the major portion of the scraping element 16 is offset at an angle of approximately 90° in relation to the plane of the intermediate blade portion 18. Preferably, though, the interior angle $\alpha$ (FIG. 2) is slightly less than 90°, say 85°, in order to provide a more aggressive scraping edge. This is, however, optional, and any suitable or convenient angle for a particular project or user preference may be incorporated. A practical range for the angle $\alpha$ may be 45°–180°. However, the optimum angle for this purpose has been found to be approximately 80°–85°.

While all other dimensions may also vary to accommodate a specific application or user, those for the preferred embodiment will now be specified. Referring to FIG. 2, the overall length "L" is approximately 9.0 inches; the length "B" of the scraping element (to the formed inches; and the length "C", height "H" and width "W" of the handle are approximately 6.5, 0.75 and 1.0 inches respectively. The width of spreader edge 24 and scraper edge 34 are approximately 0.75 and 2.0 inches, respectively. The nominal thickness of the common "blade" material from which the integral spreader element 14, scraper element 16 and intermediate blade portion 18 are fabricated is approximately 0.05 inches.

Another important feature of the invention is the provision of a lubricious coating 44 on the scraper and spreader elements (16 and 14, respectively) which facilitates cleaning and removal of fast drying fillers, adhesives, or the like. In the preferred embodiment, such coating 44 is preferably a synthetic resinous fluorine coating, such as a polytetrafluoroethylene coating, including, but not limited to, that product sold under the trademark TEFLON. The entire blade material may be covered by the such an aforementioned coating as a manufacturing convenience.

Finally, the configuration and materials of construction of the spreader and scraper elements (14 and 16, respectively) determine their respective flexibility and stiffness, expressed as "spring rates"; optimally, for the spreader element: 20 lbs. per inch, but with a practical range from 10 to 30 lbs. per inch, and for the scraper element: optimally 200 lbs per inch, but minimally; 50 lbs. per inch (no maximum limit).

Furthermore, various changes in the construction and arrangement of the components may be made without departing from the spirit of the invention, as will be apparent to those skilled in the art. For instance, a suitable plastic may be substituted for the steel blade, although the latter is a better choice for toughness and durability. Reference is made to the appended claims for a definition of the limits of the invention.

The invention claimed is:

1. A woodworking tool comprising an elongate handgrip; a scraper element having a first substantially straight edge at one end of said handgrip; and a spreader element having a second substantially straight edge at the other end of said handgrip, said first and second edges being substantially parallel to each other, said spreader element being substantially more flexible than said scraper element, whereby the stiffer scraper element and more flexible spreader element may be alternatingly used to prepare a wood surface for finishing by reversing the relative positions of said elements within the hand of the user.

2. A woodworking tool as defined in claim 1, wherein said handle defines a longitudinal axis of the tool, said spreader element extending from said handle along a direction substantially co-extensive along said longitudinal axis.

3. A woodworking tool as defined in claim 1, wherein said scraper element has a sharp scraping edge formed by bevels on at least one side of the element.

4. A woodworking tool as defined in claim 1, wherein said spreader element has a length selected within the range of 1–6 inches.

5. A woodworking tool as defined in claim 4 wherein said spreader element has a length of approximately 2 inches.

6. A woodworking tool as defined in claim 1, wherein the spring rate of said spreader element is selected within the range of 10–30 pounds per inch, and said scraper element has a minimum spring rate of 50 pounds per inch.

7. A woodworking tool as defined in claim 1, wherein said handle defines a longitudinal axis of the tool, said scraper element extending from said handle along a direction substantially co-extensive along said longitudinal axis and having an operative portion inclined relative to said handle longitudinal axis less than 90°.

8. A woodworking tool comprising an elongate handgrip defining a longitudinal tool axis; a scraper element at one end of said handgrip having a first substantially straight edge; and a substantially planar metal spreader element at the other end of said handgrip having a second substantially straight edge, said spreader element being substantially more flexible than said scraper element, said scraper element extending from said handle along a direction substantially co-extensive with and along said longitudinal tool axis and having an operative portion including said first edge, which is substantially normal to said longitudinal axis, whereby the stiffer scraper element and more flexible spreader element may be alternatingly used to prepare a wood surface for finishing by reversing the relative positions of said elements within the hand of the user.

9. A woodworking tool comprising an elongate handgrip; a scraper element at one end of said handgrip; and a spreader element at the other end of said handgrip, said spreader element being substantially more flexible than said scraper element, whereby the stiffer scraper element and more flexible spreader element may be alternatingly used to prepare a wood surface for finishing by reversing the relative positions of said elements within the hand of the user, said scraper and spreader elements being integrally formed with an intermediate body portion, said handle being formed of two handle portions arranged on opposite sides of said intermediate body portion.

10. A woodworking tool as defined in claim 9, wherein said handle body portions are secured to each other and to said intermediate body portion by fastener means.

11. A woodworking tool as defined in claims 10, wherein said fastener means comprises a rivet and a grommet at opposite ends of said handle.

12. A woodworking tool as defined in claim 9, wherein said intermediate body portion has a substantially uniform thickness over the length of said handle and tapering at least at one end to form a flexible spreader.

13. A woodworking tool as defined in claim 12, wherein the taper starts where said intermediate body portion joins said spreader element.

14. A woodworking tool comprising an elongate handgrip; a scraper element at one end of said handgrip; and a spreader element at the other end of said handgrip, said spreader element being substantially more flexible than said scraper element, whereby the stiffer scraper element and more flexible spreader element may be alternatingly used to prepare a wood surface for finishing by reversing the relative positions of said elements within the hand of the user, at least one of said scraper and spreader elements being provided with a lubricious coating for preventing spread and scraped materials from sticking to its surfaces.

15. A woodworking tool as defined in claim 14, wherein said lubricious coating is a synthetic resinous fluorine coating.

16. A woodworking tool as defined in claim 14, wherein both elements are provided with a lubricious coating.

17. A woodworking tool comprising an elongate handgrip; a scraper element at one end of said handgrip; and a spreader element at the other end of said handgrip, said spreader element being substantially more flexible than said scraper element, whereby the stiffer scraper element and more flexible spreader element may be alternatingly used to prepare a wood surface for finishing by reversing the relative positions of said elements within the hand of the user, the spring rate of said spreader element being selected within the range of 10–30 pounds per inch, and said scraper element having a minimum spring rate of 50 pounds per inch.

18. A woodworking tool as defined in claim 17, wherein the spring rate of said spreader element is approximately 20 pounds per inch.

19. A woodworking tool as defined in claim 17, wherein the spring rate of said scraper element is approximately 200 pounds per inch.

20. A woodworking tool comprising an elongate handgrip; a scraper element at one end of said handgrip; and a spreader element at the other end of said handgrip, said spreader element being substantially more flexible than said scraper element, whereby the stiffer scraper element and more flexible spreader element may be alternatingly used to prepare a wood surface for finishing by reversing the relative positions of said elements within the hand of the user, said spreader element having a cross section of minimum thickness at an intermediate point along its length thereof to facilitate flexing.

21. A woodworking tool as defined in claim 20, wherein said spreader element is approximately 2 inches long, and said minimum thickness cross section is located approximately one inch from the tip thereof.

22. A woodworking tool comprising an elongate handgrip defining a longitudinal tool axis, a metal scraper element formed of a substantially flat material having a first portion substantially co-extensive to said tool axis extending from said handgrip and a second portion integrally formed with said first portion and arranged substantially normal to said tool axis, a metal spreader element at the one end of said handgrip formed of a substantially flat material, said spreader element being substantially more flexible than said scraper element, whereby the stiffer scraper element and more flexible spreader element may be alternatingly used to prepare a wood surface for finishing by reversing the relative positions of the said elements within the hand of the user.

23. A woodworking tool as defined in claim 22, wherein said spreader element and said scraper element first portion are arranged in a common plane substantially coextensive with said tool axis.

* * * * *